United States Patent [19]

Bongartz et al.

[11] 3,979,802

[45] Sept. 14, 1976

[54] SNAP FASTENER

[75] Inventors: Heinz Bertram Bongartz, Hilden; Gunter Wolfertz, Wuppertal-Barmen; Reimund Stanik, Wuppertal-Beyenburg; Gottfried Kraft, Moschede, all of Germany

[73] Assignee: Firma Schaeffer-Homberg GmbH, Wuppertal-Barmen, Germany

[22] Filed: Mar. 21, 1974

[21] Appl. No.: 453,299

[52] U.S. Cl. ..... 24/213 R; 24/DIG. 17; 24/213 CS; 24/107; 24/216; 24/221 R

[51] Int. Cl.[2] ..... A44B 17/00

[58] Field of Search ..... 24/DIG. 17, 213 CS, 24/213 R, 220, 214, 216

[56] References Cited

UNITED STATES PATENTS

| | | | |
|---|---|---|---|
| 615,336 | 12/1898 | Adams | 24/214 |
| 628,618 | 7/1899 | Adams | 24/213 CS |
| 681,086 | 8/1901 | Washburne | 24/214 |
| 707,504 | 8/1902 | Dowse | 24/216 |
| 753,525 | 1/1904 | Smith | 24/216 |
| 776,838 | 12/1904 | Higgin | 24/220 |
| 1,084,269 | 1/1914 | Greenebaum | 24/220 |
| 1,198,567 | 9/1916 | Morley | 24/208 R |
| 1,268,870 | 6/1918 | Moss | 24/214 |
| 1,402,951 | 1/1922 | Olson | 24/DIG. 17 |
| 2,648,110 | 8/1953 | Baskind | 24/DIG. 17 |
| 2,799,910 | 7/1957 | Weber | 24/216 |

*Primary Examiner*—Bernard A. Gelak
*Attorney, Agent, or Firm*—Ernest G. Montague; Karl F. Ross; Herbert Dubno

[57] ABSTRACT

A snap fastener which comprises a male part, a female part, and the male part has on its top an insertion detent means for holding a decorative cover part.

2 Claims, 32 Drawing Figures

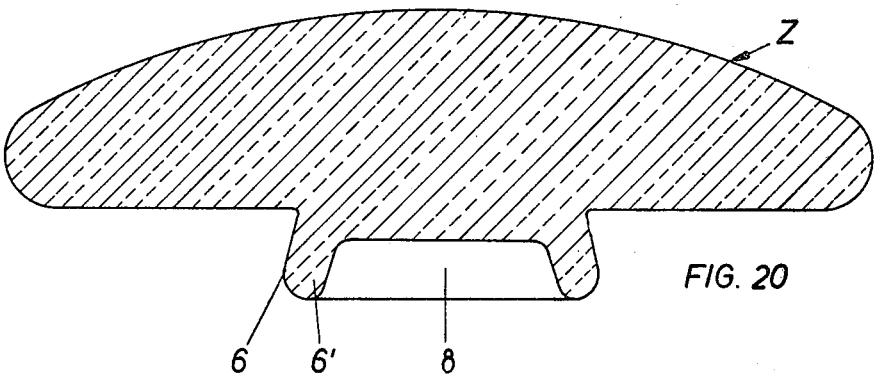
FIG. 20
FIG. 21
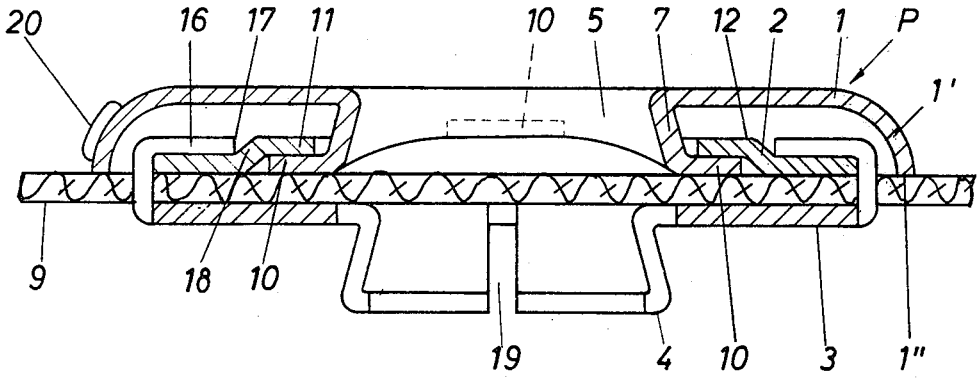
FIG. 22
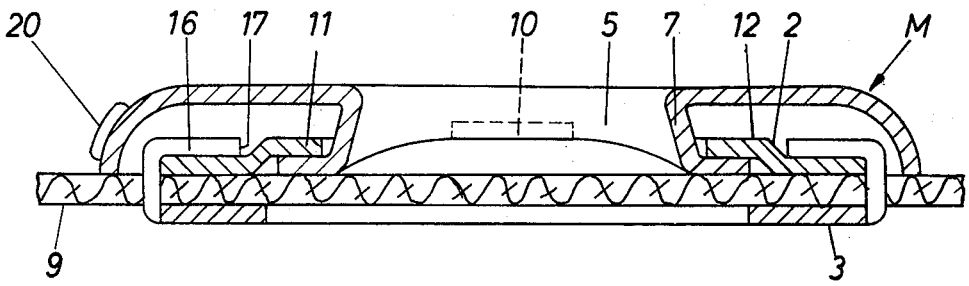

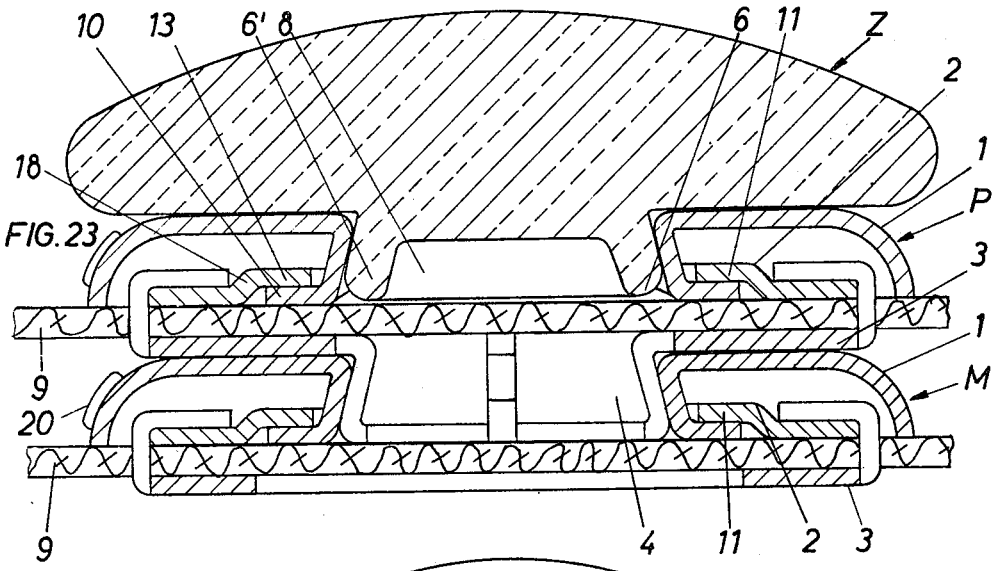
FIG. 24
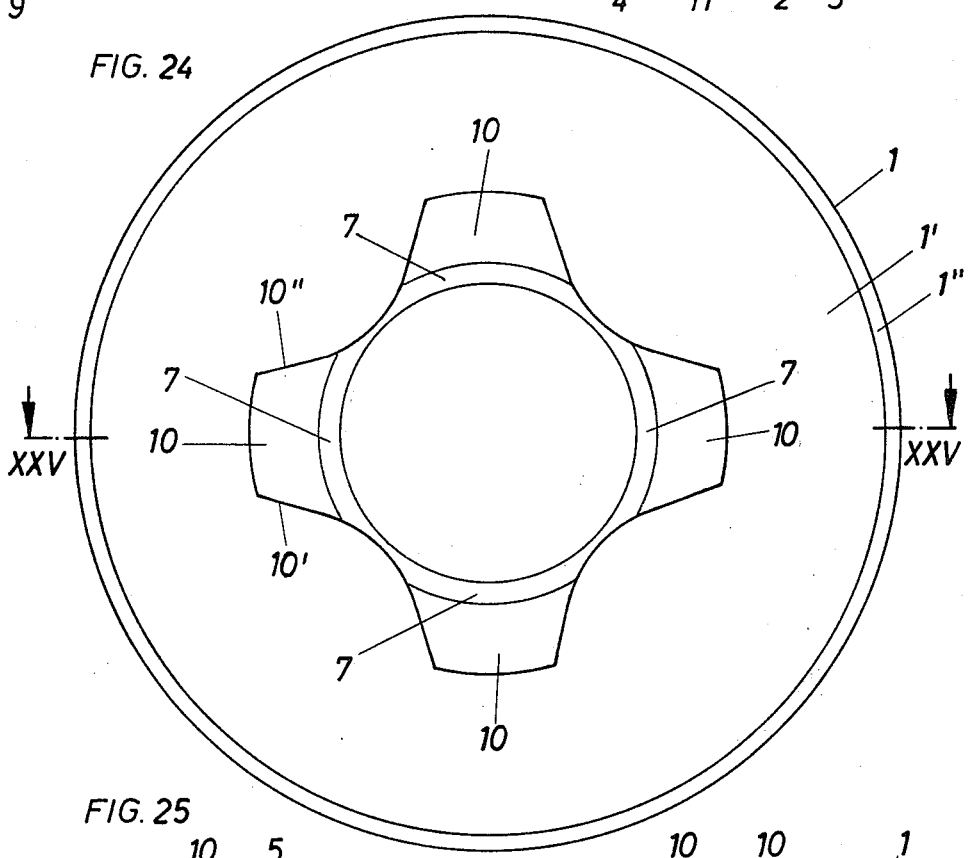
FIG. 25
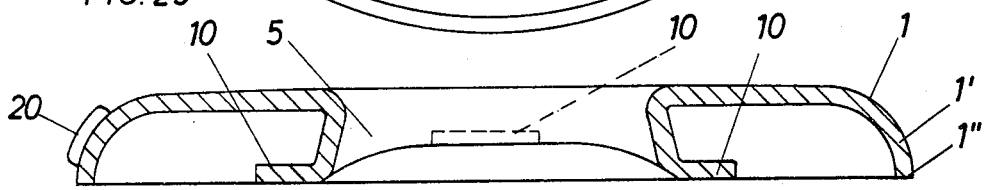

FIG. 29
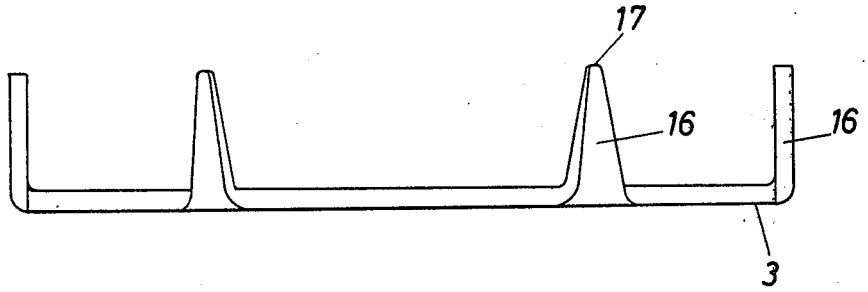
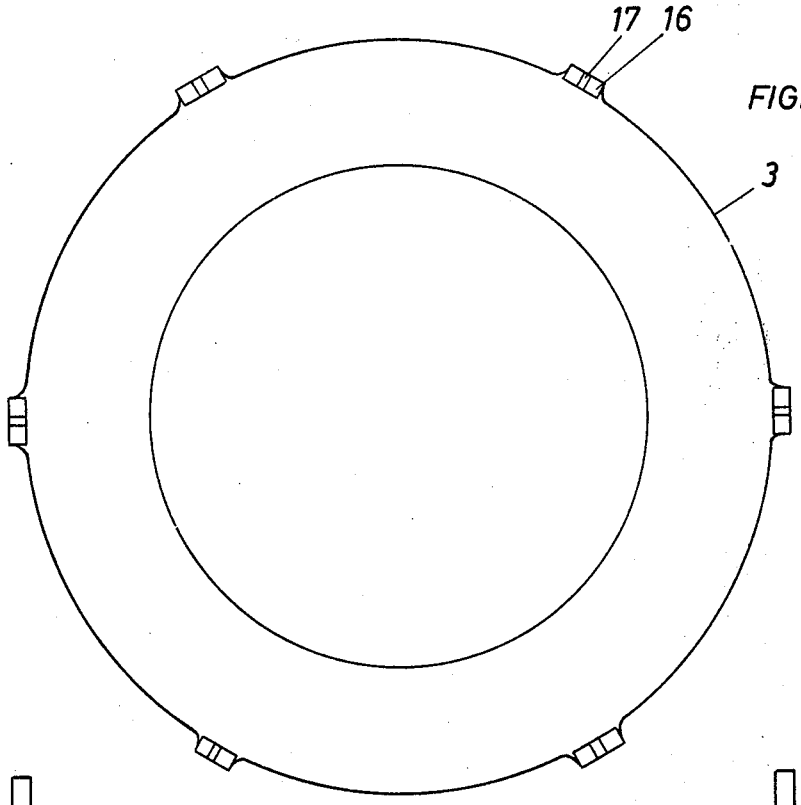
FIG. 28
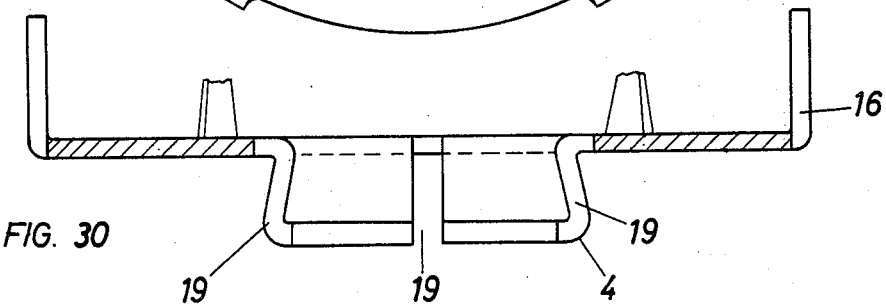
FIG. 30

SNAP FASTENER

The present invention relates to a snap fastener.

In known constructions, the half of the snap fastener which is referred to as the male part, has the ball formation and a half which is referred to as the female part has a socket receiving this formation.

The attachment of the two halves of the snap fastener to the supporting fabric requires additional means which, depending on the purpose of the snap fastener, is constructed to do the least possible damage to the fabric, such as, for instance, so-called claw plates. The claws themselves are pointed and when inserted through the supporting fabric widen the mesh so that the cutting of the threads is substantially excluded. The free ends are bent over on the other side of a base plate of the respective part of the snap fastener. The field of use of such snap fasteners is extremely large since they fulfill the function of fastening in a very unobvious manner. As a rule, the male part is anchored flat behind a covering strip so that the necessity or problem of a direct decorative covering does not arise here. On the other hand, however, it is also known to cover the invisible halves of the snap fastener by machine with a non-removable or permanent decorative cap.

It is an object of the present invention, to provide a snap fastener by a simple method of manufacture and in the smallest possible structural height in a manner advantageous to use. This object is achieved in that the snap fastener whose basic function is to fasten is given, by the provision of a decorative element, also a decorative function which remains present when the snap fastener is open and which can be associated as desired with fashion applications; the holding means necessary for this purpose are simple, operate reliably, and do not require any additional parts, but rather are of simpler manufacture than the known snap fasteners and remain more securely in their position. In addition, the snap fasteners of the present invention even have; the advantage that they are easier to apply to the specific articles of use.

According to the present invention, the male part is provided on its top with a socket to receive and hold a decorative covering part by a reversible snap connection between the male part and the decorative covering part.

The top plate of the male part can be provided, extending from the edge over which known holding claws grip, with an inwardly directed upwardly bent section, the flanged edge of which forms the central socket opening.

One favorable feature of the invention is that the section extends up in the form of a conical frustum.

In accordance with the invention this the section extends upwardly in stepwise manner.

The invention furthermore proposes that the edge of the central opening be formed with individual barb-like tongues which extend obliquely downwardly into the opening in order to obtain an irreversible fastening of the decorative covering part.

Another advantageous embodiment consists in accordance with the invention in the female part also having a plug-in type socket for holding a decorative covering part.

Thus each snap-fastener part can be provided individually on its one broad side with a female opening and on the opposite broad side with a male projection which is adapted for locking in the female opening. The male projection can bear the decorative covering.

It is advantageous, in accordance with the invention, for the male projection to be anchored in a hollow in the decorative part and have a central opening for the entrance of a centering pin of the decorative part.

A claw like anchoring is provided between the outer surface of the pin and the tongues of the male projections.

The small projection can extend from a plate which is of smaller area than the decorative part and which has on its edge holding claws which engage over the bottom plate which bears the female opening. Both the male projection and the female opening should be formed of elastically resilient individual tongues.

One favorable feature of the invention is that the centering pin extends conically towards the free end.

In this connection it is advantageous in accordance with the invention that both the female part and the male part have masking tops of identical shape which are coupled by a push-and-turn bayonet connection with a holding part fastened to the fabric and which form the central snap-fastener socket which is closed in the case of the male part by a decorative element which is snapped into it.

Furthermore, the invention provides that the mask upper part be provided with outwardly directed wings which extend from the socket wall and with which there are associated passage openings in the upper plate of the holding part, supporting shoulders which are gripped by the wings and extend in the circumferential direction of the top plate adjoining such passage openings.

Another advantageous embodiment is provided in accordance with the invention in that the wings are alternately staggered in height and alternately grip above and below the supporting shoulders.

The supporting shoulders can be formed of the upwardly bent inner-wall annular zone of the upper plate.

One favorable feature of the invention is that the downward bent edge of the masking top can rest on the supporting material.

In this connection it is advantageous in accordance with the invention that at least the upper plate of the holding part of the male part and of the female part be of in the same shape.

The invention furthermore proposes that the claw plate of the male part continue into the snap-fastener button.

Still another advantageous development of the invention is provided by the fact that the mask upper part has turn-gripping projections on its outer surface.

Finally, it is favorable in accordance with the invention for the mask upper part to extend as a cover up to above the bent claws of the claw plate.

As a result of such development, a snap fastener of increased value is created. While retaining the previous function of a fastener, there is now added, with minimum structural height, the favorable decorative function, such that the decorative covering part can even serve as ordinary button which can replace the conventional sewn button. The decorative cover part also serves as gripping means for the fastener. As a result, no unusual manipulations occur. The structural members are maintained extremely simple. The male part is provided on top with an insertion socket in order to hold the decorative cover part. The reversible snap connection between male part and the decorative cover part which is employed results in a large number of advantages: Firstly there is a wide range of variations for the decorations which can be applied. The possible loss of the decorative cover part is no difficulty since the cover part is rapidly replaced. If this decorative cover part serves a button function, resewing is unnecessary. Upon drycleaning or washing, the decorative cover part can if necessary be detached from the male part in order to protect it — depending on the nature of its surface, its type of material, etc. — from possible damage due to strong mechanical or chemical action. The snap fastening as such, however, is also advantageous since small tilting movements of the connected parts are compensated for without impairing the security of the fastening. The snap fastening is effected in the manner that the top plate of the female part, extending from the edge over which the conventional holding claws grip, has an inwardly directed upwardly raised section whose flanged edge forms the central socket opening. The upward displacement of the flanged edge also makes it possible, despite a compact shape, to improve the entrance into the socket also from an optical standpoint. The frustoconical shape of this section which is selected results, together with the flanged edge, in excellent stabilization, so that very thin material can be used, which in its turn benefits the small structural height desired. The same purpose is also served by the measure of developing the section in step shape. The corresponding step can be placed so far into the region of the edge that it terminates directly in front of the pointed ends of the holding claws which grip over the edge of the upper plate of the male part. Since the step also extends over the thickness of the holding claws, advantageous protection is obtained from direct mechanical action, for instance the bending of said claws. However, a favorable irreversible mounting of the decorative part is also possible in accordance with the invention if the edge of the central opening is shaped into individual barb-like tongues which extend obliquely downward into the opening. This solution has the advantage that the corresponding association of the decorative cover part can be carried out without the use of tools. For example, for the reversible or irreversible adding of a second or inner head, the female part can also have an insertion socket to hold this button or the decorative cover part.

In order to obtain still further advantages with respect to application to corresponding articles of use, and particularly articles of clothing, the two base parts of the snap fastener which are to be fastened to each other can be shaped in the same manner. This greatly simplifies manufacture. The number of operations for the production of the entire snap fastener is reduced. In addition to a saving of tools, simplified assembly is also obtained since, in addition to the decorative part, there are only two different structural parts which can be used both for the one part of the snap fastener and for the other. To this end, each male projection fits in interlocking manner in each female opening. This also results in advantages in shipment, as well as sale. Snap-fastener top parts as well as snap-fastener bottom parts can be stored without regard to whether they are to be used subsequently as the male part or the female part. This possibility of storage results in advantages also with respect to the application of the snap fasteners by machine to the articles of use. The expense is substantially reduced in particular in the case of articles of clothing. Separate arrangement as well as separate storage is no longer necessary; both parts of the snap fastener can be associated by machine with the article of clothing, namely on both overlapping sections of the clothing, regardless of the subsequent manner of buttoning. This not only results in the advantage that the female part and the male part cannot be confused so that improperly produced articles occur, but, on the contrary, with the same arrangement of the structural parts both on men's and on women's clothes, the customary manner of buttoning can be determined subsequently. The decorative cover part will then be associated with the outside part of the snap fastener; by the development in accordance with the invention, it is possible, despite unsorted arrangement of the snap-fastener parts on the overlapping sections of clothing, to associate the decorative cover part in each case with the outwardly facing section of the corresponding snap-fastener part, depending on the manner of buttoning, regardless of whether this snap-fastener part serves as male part or as female part extends into the decorative part. The decorative part, which is preferably made of plastic, can remain free of thin-walled sections when the fastening section of the male part extends into the female part. The interlock between the decorative cover part and the male projection takes place in stable fashion, and the material of the decorative part need not be elastic; the evasive movement for the interlocking is effected by the elastic deflection of the tongues of the male projection. By this measure, even rigid decorative parts of metal can be used, depending on the article of clothing. The decorative part comes into a favorable locking position as a result of the centering.

The conical shape of the pin has various advantages. On the one hand the possibility of evasion for the male projection is provided in the first detent section, while on the other hand in the final detent position the pin lies in properly fitting manner in the central opening of the male projection. In this way a very stable connection is obtained. In order to pull the decorative cover part off from the male projection, for instance so that the decorative part will not be subjected to mechanical or chemical action upon the cleaning of the article of clothing, there are thus required forces which considerably exceed the detent forces of the detent point between the male part and the female part. The decorative cover part thus forms a true gripping handle which can be loosened only intentionally but cannot come loose unintentionally, i.e. during disengagement of the male and female parts. The form-fitting insertion of the center in this even produces the advantage of a claw-gripping by the tongues. The decorative cover part is fixed fast against rotation. In addition to the advantages of technique of use, an optically pleasing solution is also created. The decorative part not only completely covers the male part, but even extends over it, so that from the outside only the decorative element is visible.

There are also advantages with regard to the reliability in use. The elastic development of the two detent means of a snap-fastener part for interlocking between the snap-fastener part serving as male part and as female part respectively results in a uniform distribution of the pressures for the obtaining of the interlock position. The forces are distributed uniformly over both sections, which increases the operating life of the interlocking means with an extremely simple development which is saving of material. The firmness of the interlocked position is not impaired thereby.

The reversible associating of a decorative element results in a large number of advantages. With suitable development, for instance, the male-side opening is closed by a decorative element which is snapped into place. When the decorative cover part serves as button in conventional sense, there is the advantage that all articles of clothing can be equipped with the same snap fastener on the same attaching machine and the decoration applied only before the packing of the article of clothing. This results in advantages in storage and fabrication. The female part can also serve to receive a decorative part without closure function. As further essential advantage, there is the easy mounting by the final consumer. The previous rivet-like association of the structural parts which clamp the fabric between them is eliminated. Thus even the mask top can be removed and replaced by another one. By loosening the mask top, the serrated ring becomes accessible. It can be taken off by the final consumer or the garment maker — if it has been mechanically damaged or attached at the wrong place — and replaced by a new snap fastener. The snap fastener is extremely durable and resistant to mechanical forces. As a result of the structural measure that the masking tops has outward directed wings extending from the wall of the socket opening, with which wings there are associated passage openings in the upper plate of the holding part which can furthermore be used for both parts of the fastener, adjoining which passage openings there are supporting shoulders which grip over the wings and extend in the circumferential direction of the top plate, precisely defined associated starting and end positions are established. This forms a favorable prerequisite for the automatic associating of the snap-fastener parts on the supporting material. If the wings are even alternately staggered in height so that they extend above and below the supporting shoulders, a fastening between the masking top part and the holding part which withstands practically all customary axial pressures is produced. The supporting shoulders are advantageously formed by the upward bent inner-edge annular zone of the upper plate. It is also desirable that the downward bent edge of the masking top part rest on the supporting material. With equal resting on the edge side of the correspondingly curved edge zone there is also obtained a protective covering of the claws of the claw plate which fixes the holding part on the supporting material. The gripping projections on the cylindrical surface of the mask top part which are finally proposed also favor the automatic associating of the snap-fastener parts on the supporting material.

Further advantages and details of the invention will be explained below with reference to several illustrative embodiments shown in the drawing in which.

Figure 14:
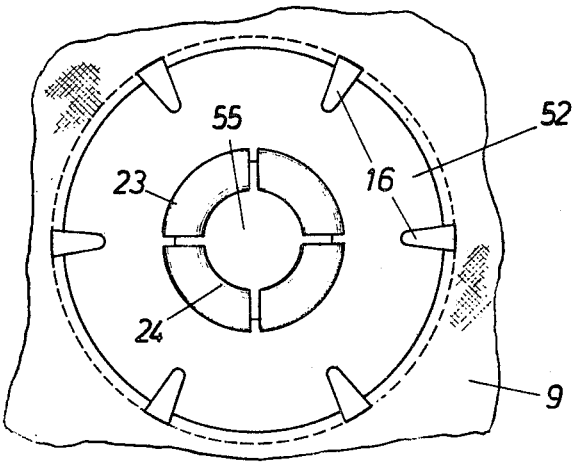
Figure 15:
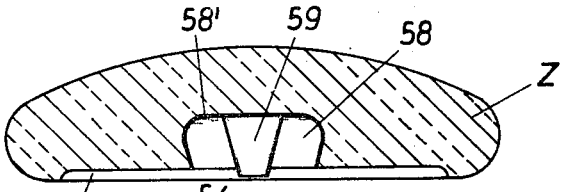
Figure 16:
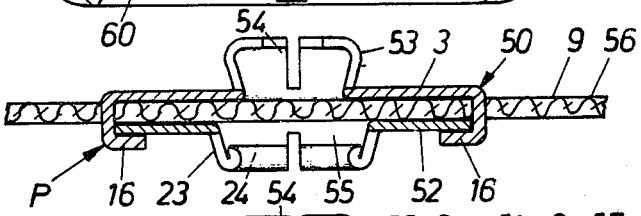
Figure 17:
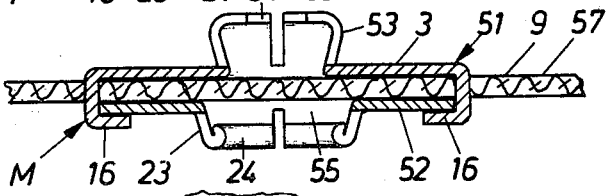
Figure 18:
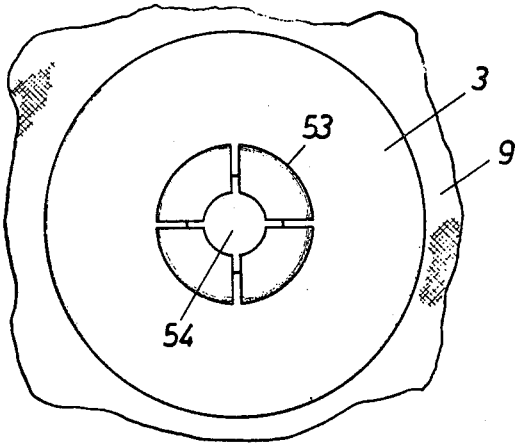
Figure 19:
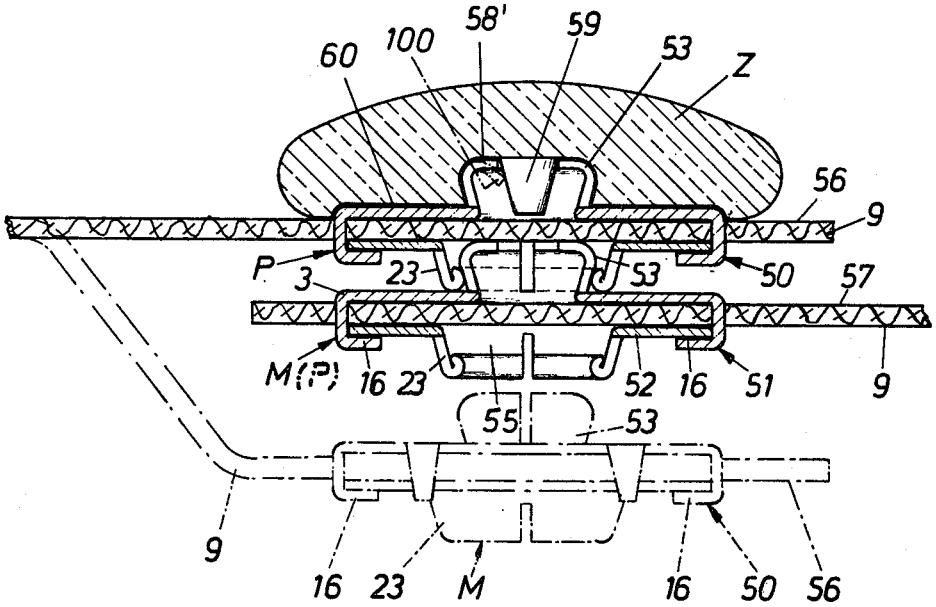
Figure 27:
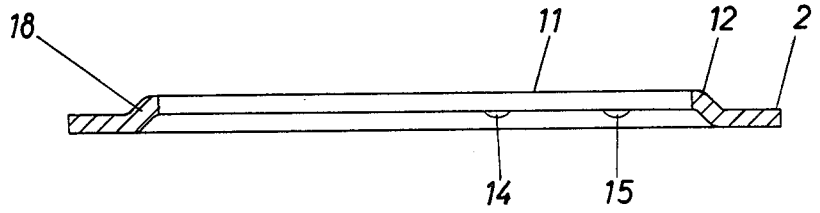
Figure 26:
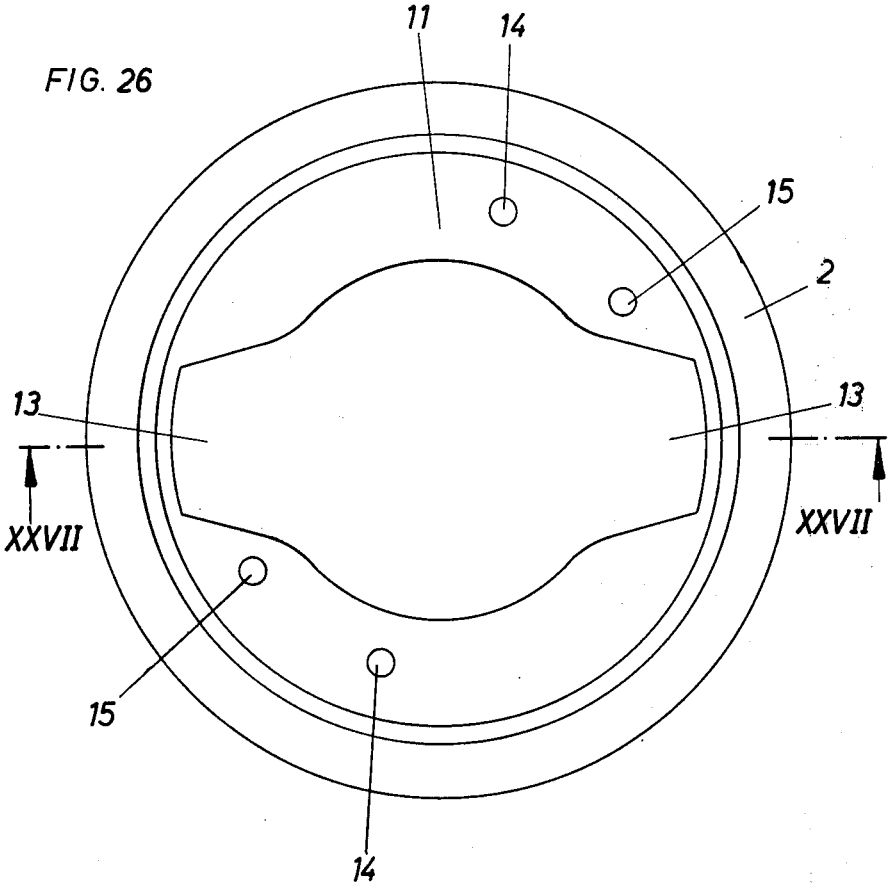
Figure 31:
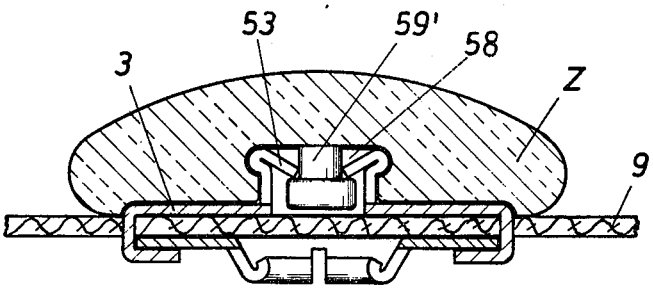
Figure 32:
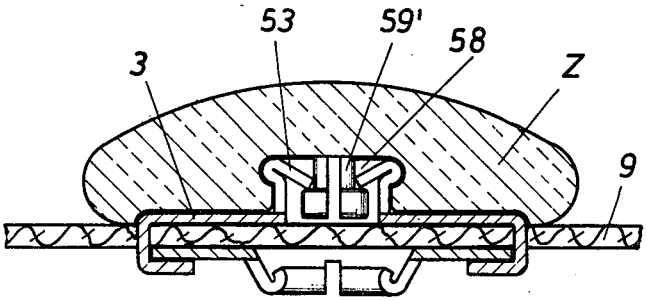

FIG. 14 is a bottom view of a snap-fastener part in accordance with the sixth embodiment, FIG. 15 is a longitudinal section through the corresponding decorative cover part, FIG. 16 is a longitudinal section through the snap-fastener part of the sixth embodiment, serving here as male part, FIG. 17 is a longitudinal section through the snap-fastener part serving as female part, FIG. 18 is a top view of a snap-fastener part, FIG. 19 shows the interlock between female and male as well as decorative cover parts of the sixth embodiment, with particular showing of the optional use as female part or male part, FIG. 20 shows the decorative element of a seventh embodiment, FIG. 21 is a corresponding section through the male part of the snap fastener in accordance with the seventh embodiment, FIG. 22 is a section through the female part, FIG. 23 is a vertical section through the snap fastener of the seventh embodiment, shown in interlocked position, FIG. 24 is a bottom view of the mask upper part, FIG. 25 is a cross section along the line XXV—XXV of FIG. 24, FIG. 26 is a top view of the mounting part, FIG. 27 is a cross section along the line XXVII—XXVII of FIG. 26, FIG. 28 is a top view of the claw plate, FIG. 29 is a side view thereof, FIG. 30 shows the claw plate in a different form than that shown in FIG. 29, and FIGS. 31 and 32 show variants of a non-detachable snap fastening between decorative element and snap fastener.

The snap fastener of the first embodiment of the invention shown in FIGS. 1 to 5 consists of the male part P and the female part M, as well as a decorative cover part Z adapted to be associated with the snap fastener.

A top plate 21 forms a part of the male part P. This plate is fastened to the supporting material 9 by a claw plate 3 which simultaneously forms the snap-fastener button 4. The holding claws 16 of this plate 3 pass through the supporting material 9 and are so bent at their end that they extend over the edge 22 of the top plate 21. The edge 22 extends parallel to the supporting material 9.

The central region of the top plate 21 is raised upward, i.e. it lifts off from the supporting material 9. The upward raised section is designated 23. The inner edge 24 of this section is flanged over and forms a central detent opening 5 for a pin-like detent projection 6 of the decorative covering part Z made, for instance, of plastic. This detent projection 6 is undercut, as can be noted from FIG. 2. In order to facilitate the making of the snap connection, it can be hollowed out in its entire depth in the region of its pin-like projection so as to produce in this way a highly elastic pin-wall section. The bottom of the pin-like detent projection 6 is kept flat. Its side or annular surface terminates shortly in front of the supporting material 9. The bottom of the decorative cover part Z, which in this case is of mushroom shape, is hollowed out so that the edge of this part covers the holding claws 16, hiding them and protecting from contact with them.

The section 23 has the course approximately of a conical frustum. Due to this and due to the flanged edge 24 which describes the insertion socket 5, the top plate 21 of the male part P is stabilized in itself.

Figure 10:
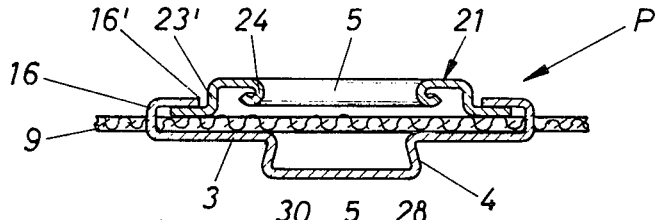
FIG. 10 is a section along the line X—X of FIG. 9.

However, as shown by the male part of FIG. 10, this section can also be raised up in stepwise manner. The corresponding step is marked 23' and lies directly in front of the tip 16' of the radially inwardly directed holding claws 16.

Figure 7:
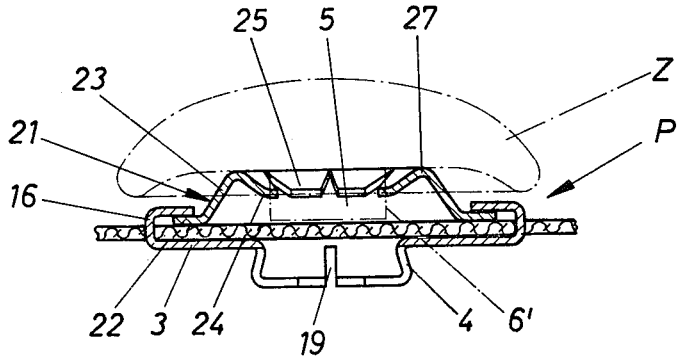
FIG. 7 is a section along the line VII—VII of FIG. 6.
Figure 6:
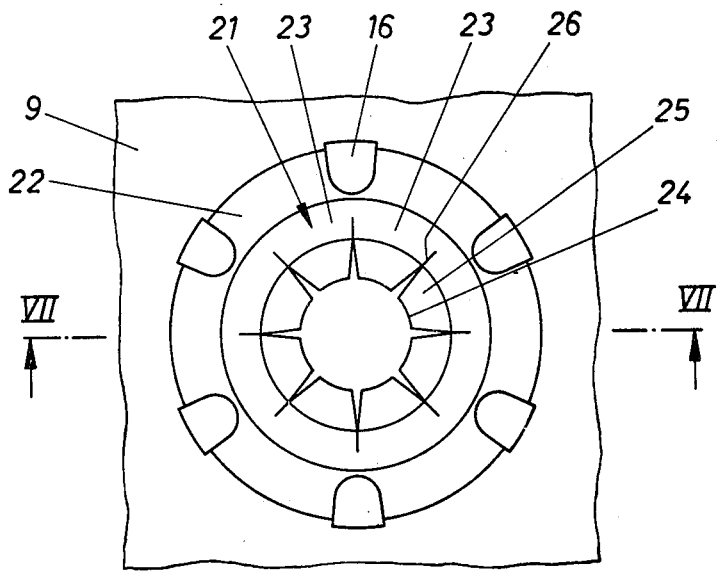
FIG. 6 shows the male part in accordance with the second embodiment.
Figure 8:
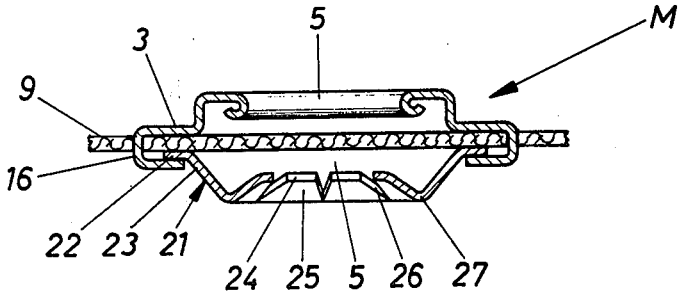
FIG. 8 shows a female part in accordance with the second embodiment.
Figure 9:
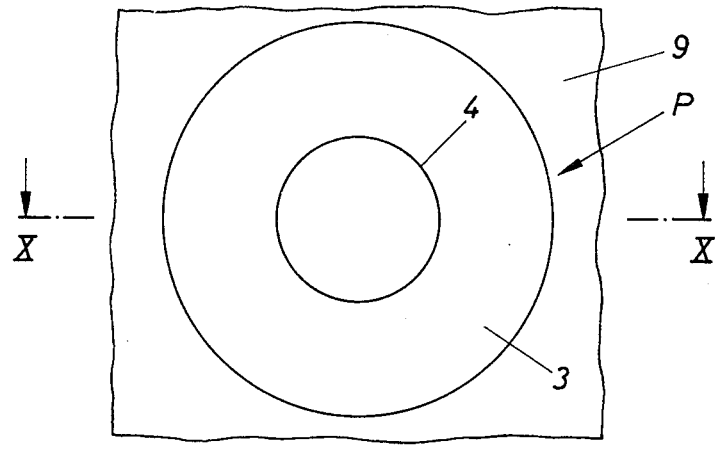
FIG. 9 shows a male part in accordance with the third embodiment.

Instead of the reversible association of the decorative cover part Z which has been described, an irreversible attachment can also be brought about if the inner edge 24 which surrounds the central opening 5 is provided, in order to form individual tongues acting like barbs, the radial separating sections 26, preferably extending up into the region of the frustoconical section 23, as shown in the second embodiment in accordance with FIGS. 6 to 8. These tongues 25 are bent at an angle at the vertex 27 so that they have an obliquely downward inclined direction and thus extend into the opening 5. The tongue ends, which are preferably sharp-edged, describe a circular opening. The diameter of said opening is smaller than the diameter of the detent projection 6 of the decorative covering part Z, which projection is in this case preferably cylindrical. The detent projection is possibly slightly undercut. Due to the fact that the bottom of the decorative cover part Z rests on the annular rib formed by the peaks 27 of the tongues 25 and the ends of the tongues moreover dig into the wall of the detent projection 6', an extremely stable irreversible attachment is obtained between male part P and decorative cover part Z.

Figure 1:
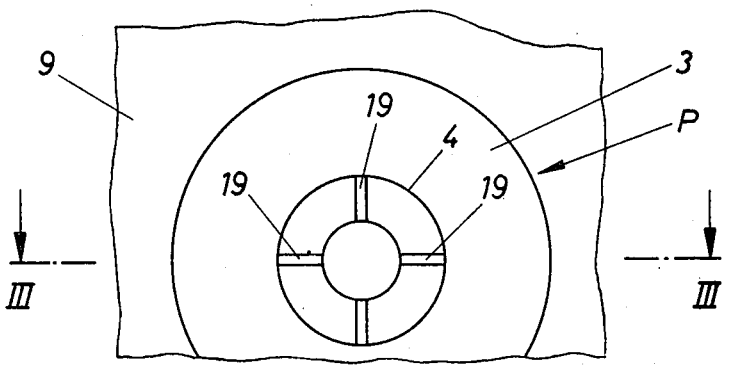
FIG. 1 shows the male part of the snap fastener.
Figure 2:
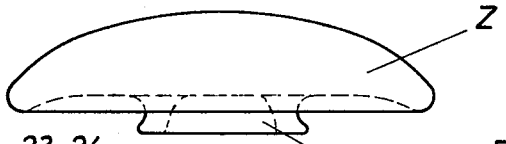
FIG. 2 shows the decorative covering part by itself.
Figure 3:
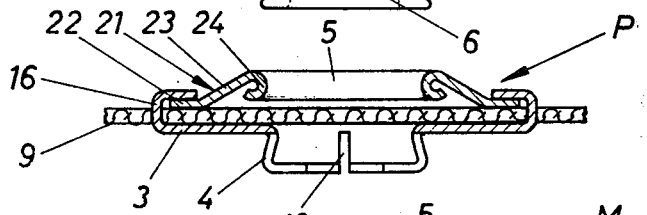
FIG. 3 is a section along the line III—III of FIG. 1.
Figure 5:
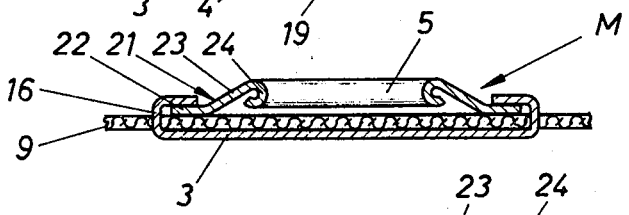
FIG. 5 is a section along the line V—V of FIG. 4.
Figure 4:
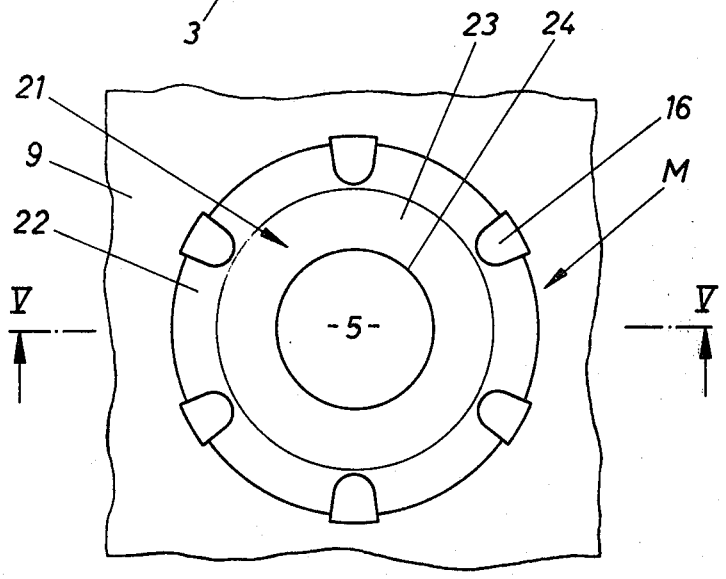
FIG. 4 shows the female part of the snap fastener.

As can be noted from FIG. 5, the snap-fastener button 4, which in this embodiment is made flexible by slitting it, is introduced, in order to produce the fastening, into an insertion socket 5 of the female part. In this case the same top plate 21 as in FIG. 3 is used. The only thing different is that in this case the claw plate 3 is closed in the center.

In FIG. 8 the female part is modified in the manner that herein the claw plate 3 forms the central insertion socket 5 for the snap-fastener button, while the top plate 21, which in this case faces downward, forms the central opening 5 for a decorative cover part Z which is to be irreversibly associated with the female part. The manner of operation of this top plate 21 has been explained above.

Figure 12:
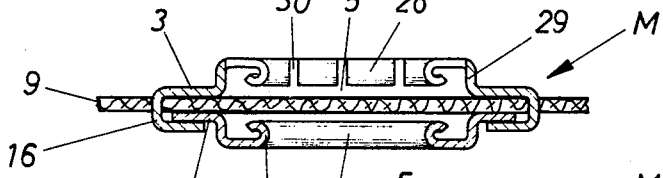
FIG. 12 is a section along the line XII—XII of FIG. 11.

The embodiment of FIG. 10 provides a snap-fastener button which is rigid, i.e. not radially elastic, which once again is integral with the claw plate 3. In contrast to this, the upward facing claw plate 3 in FIG. 12 of the female part is adapted to the requirements of elastic action, in that the flanged edge 28 forming the insertion socket 5 for the snap-fastener button 4 has radial slits 30 extending to the step 29. The top plate 21 which is facing downward in FIG. 12 corresponds to the manner of construction already described in FIG. 10. It serves to apply a decorative cover part Z to the female part.

Figure 13:
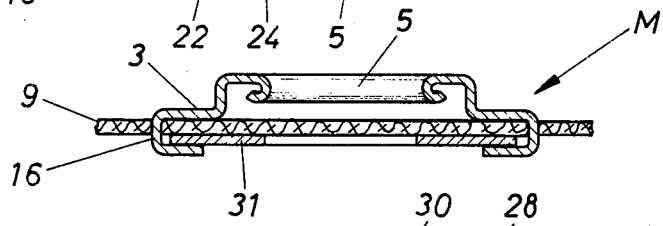
FIG. 13 shows a fifth variant of the female part.
Figure 11:
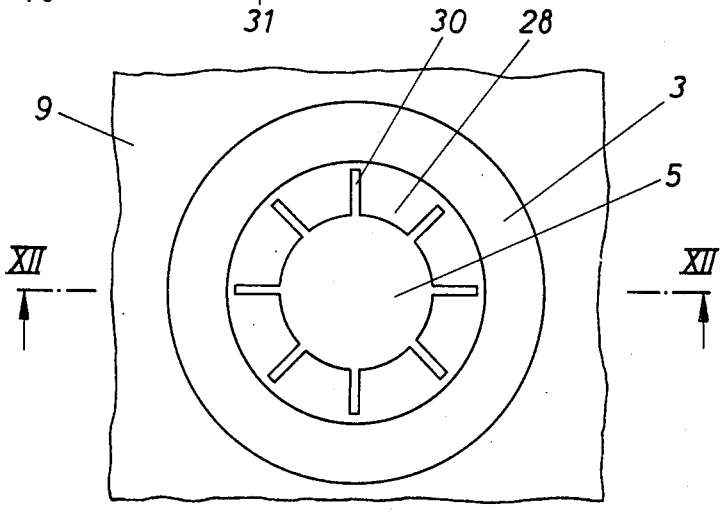
FIG. 11 is a top view on another modified embodiment of the female part.

The development of FIG. 13 differs from that of FIG. 8 merely by the fact that the claw plate 3 which is located on top has associated with it an annular plate 31 which is gripped by the holding claws.

In the embodiment shown in FIGS. 14 to 19, the snap fastener also consists of two structural parts 50, 51 necessary for the purpose of the fastening, each of which individually, as shown in FIG. 19, can serve alternately as male part P or as female part M. In the embodiment shown in the drawing, the part 50 is to be considered as male part P and the part 51 as female part M.

Aside from these parts, the snap fastener also has a decorative cover part Z which can be associated with it. The parts 50, 51 are of identical development, each by itself having a claw plate 3, in this case located on the top, and a bottom plate 52, the claw plate 3 bearing the upward directed, undercut male projection 53 serving as snap-fastener button, which projection has tongue-like, elastic sections as a result of vertical slots extending up into the plane of the claw plate and has a central opening 54 on the top. The bottom plate 52 in this case has an upward raised section 23 which forms the female opening 55 whose inner edge 24 is flanged; the upward raised section 23 also forms elastic tongues as a result of slits extending up into the plane of the bottom plate.

Depending on the use made on given articles, the upward raised section 23 may also be developed without slits, in which case the yielding movement for the interlocking is then provided solely by the tongues of the male projection.

Each part 50 or 51 is fastened in the following manner to the corresponding sections 56 and 57 respectively of the supporting material 9: The claw plate 3 is pressed on the outside against the supporting material so that the mounting claws 16 which are directed opposite to the male projection 53 pass through the supporting material; the bottom plate 52 is then placed on the other side of the supporting material in the annular space formed by the holding claws 16 and gripped by thereupon bending over the ends of the holding claws in such a manner that the claw plate 3 and the bottom plate 52 are clamped against each other with the interposition of the supporting material 9.

The male projections 53 are in this case adapted for interengagement with the female openings 55, i.e. the male projection of the part 50 fits in locking fashion in the female opening of the part 51, but the male projection of the part 51 also fits in the female opening of the part 50.

The ornamental part Z is provided with a correspondingly shaped cavity 58 for interlocking with the male projection 53 of the corresponding male part P. The male projections 53 of the two parts 50, 51 fit into this cavity 58.

From the roof 58' of the cavity 58, a downward conically tapering centering pin 59 extends centrally. The pin 59 is so dimensioned that its larger cross section located in the vicinity of the roof fits in form-fitting fashion in the central opening 54 of the male projection in interlocked position with the male projection.

Aside from the cavity 58, the decorative cover part Z also has a recess 60 on its bottom, which recess is adapted to the shape of the claw plate 3; when the decorative cover part Z is in engaged position with the male projection 53, the recess 60 receives the claw plate 3 in such a manner that it is invisible from the outside.

As already mentioned, FIG. 19 shows the possibility of using the parts 50, 51 either as male part P or as female part M. The solid lines show the part 50 in the position serving as male part P. The part 51 in this case forms the female part M.

With due consideration of the different manners of buttoning in particular women's and men's garments, the parts 50, 51 can also be so arranged that the part 50 which is associated with the section 56, as shown in dash line, serves as female part M. The decorative part Z would in this case be engaged with the male projection 53 of the part 51, which in this case lies on top.

For an arrangement of the decorative part on the male projection in which it also engage by claw action in axial direction, the edges of the central passage opening 54 of the male projection 53 can also be flanged inward, as indicated in FIG. 19 by the reference number 100.

A further embodiment, shown in FIGS. 20 to 29, also has male part P, female part M, and a decorative element Z.

The components of the male part P as well as of the female part M are in this embodiment in each case one masking top part 1, a holding part 2, and a claw plate 3. The masking top parts 1 are of identical development.

The holding parts 2 are also of the same development.

The claw plates 3 are also of the same development with regard to their specific function; the claw plate 3 associated with the female part M is merely continued into a centrally located snap-fastener button 4. The latter cooperates with the correspondingly centrally located snap-fastener socket 5 of the masking top part 1 of the female part M.

The corresponding socket 5 of the male-side masking top part 1 is closed by the detent projection 6 of the snap-in decorative element.

The decorative element consists of plastic or in any event of material of sufficient flexibility. The pin-like detent projection is undercut corresponding to the oblique course of the wall 7 of the socket. In order to facilitate the introduction of the snap engagement, the projection 6 over a portion of its length has a cavity 8 extending from the face end. It leads to a highly elastic annular bead 6' which continues in the last third of the length of the button into the solid and thus also more resistant button section. The bottom of the decorative element Z is flat so as to obtain a snug fit thereon on the masking upper part 1. As can be seen, the cap-shaped, button-like decorative element Z extends over the masking upper part 1 which can be adapted in color and structure to whatever is desired. As a result of the protrusion, the decorative element Z can also be used as handle or directly as button if the holding force of the detent projection 6 is greater than of the snap-button detent force.

The dish-shaped masking upper part 1 is associated with the holding part 2 which is fastened by means of the claw plate 3 to the supporting material 9 by the reversible insert-and-turn connection. For this purpose wings 10 protrude from the retracted detent socket wall 7. The wings are directed outward. As shown in FIG. 24, the masking upper part has a total of four such wings. They are distributed at equal angles apart but alternately displaced in height so that the wings 10 pass above and below supporting shoulders 11 of the upper plate 12 of the holding part 2. The upper plate 12 has two passage openings 13 which take into consideration the contour of two diametrically opposite wings 10 and extend from a central opening 3'. For the coupling of the two parts 1 and 2, the lower wings 10 are aligned with the openings 13, inserted and turned 45°. In this connection the bottom wings 10, i.e. the wings furthest away from the decorative element Z, move over detent projections 14 produced by pimples, so that their narrow edges 10' lying in direction of rotation come against end stops 15 which are also produced by pimples. In the engaged position, the wings are held secured against rotation at both narrow edges 10' and 10'' between the pimples which are a corresponding distance apart from each other.

The upper plate 21 which forms the shoulders 11 is obtained by indenting the central section of the holding part 2. The depth of indentation corresponds approximately to the thickness of the wings, so that the bottom of the wings terminates on the same plane as the bottom of the holding part 2. On this plane there also terminates the edge 1' bent over the point of fastening between the holding part 2 and the claw plate 3, which edge rests by means of the end surface 1'' on the supporting material 9. The end surface 1'' can also be bent outward in order to protect the supporting material.

The claw plate is provided on its circumference with uniformly distributed pointed claws 16. The latter are obtained by tabs which are cut out freely and then bent upward. The claw points 17 are rounded so that when the supporting material is fabric, these claws pass through the supporting material, with a widening of the meshes, and are then bent over in the direction towards the holding part, their tips 17 then coming into position directly in front of the bend 18 forming the supporting shoulders 11.

The claw plate associated with the male part P differs from the claw plate associated with the female part M only by the fact that the claw plate 3, as already mentioned, continues into the centrally located snap-fastener button 4. The latter is plotted crosswise. The corresponding slitting 19 is continued up into the region of the claw plate 3. The button 4 is also undercut by a corresponding course of the wall of this embossed button so that it cooperates with the wall 7 of the masking upper part which is undercut with the same angle. The face end of the button 4 is left open. In the case of the claw plate 3 associated with the female part M, the central region is punched out, as a result of which the supporting material 9 can still move away somewhat.

It is advantageous, particularly for the completely automatic associating and connecting of the masking upper parts with the holding parts 2, if mounting markings or grip projections 20 are provided on the outer surface of these masking upper parts. They can be taken into consideration upon the embossing and furthermore be used to facilitate the opening of the push-and-turn connection by hand. Holding parts can also advantageously be provided with projections to assure automatic feeding in correct position. The central snap-fastener socket 5 can also be developed polygonally, particularly, for instance, for the aligning of decorative emblems, or else for the automatic mounting in correct position and the transmission of the rotary fastening forces.

In accordance with the variants of FIGS. 31 and 32, the decorative part Z is provided for the interlocking with the snap-fastener projection 53 of the claw plate 3 with an undercut cavity 58 having a central, mushroom-shaped pin 59'. The tabs of this projection 53 which are cut free by cross-slotting down to the base of the claw plate 3 are bent inward and then bent back, for instance, in the direction towards the plate 3. For the claw-holding action, the tabs come below the edge of the pin obtained as a result of the mushroom-shaped thickening.

In this connection the relatively rigid outer wall of the cavity 58 forms the peripheral supporting surface. In order to make possible passage through the annular space of the cavity which is of smaller cross section, the bent-back tabs move for a short time away and then come in barb-like fashion below the edge of the mushroom. The narrow pass in the case of the embodiment shown in FIG. 31 is overcome essentially by plastic deformation of the end-thickened pin and slight removal of material on same and on the wall of the cavity and, in the case of the embodiment shown in FIG. 32, essentially by the slit pin in this case which can be compressed in the elastic region by the amount necessary for the passage of the snap-button projection 53. In both cases pushing-in is readily possible by hand. By the oblique position of the flanged projection tabs shown in the drawing, an undetachable connection is obtained. Pulling forces which act on the decorative part Z result in an increase in the effect of the action of the claws. The tabs are pressed even firmer into the undercut base of the cavity.

While we have disclosed several embodiments of the present invention it is to be understood that these embodiments are given by example only and not in a limiting sense.

We claim:

1. A snap-fastener assembly, especially for convertible cuffs and other fabric parts to be joined in a variable manner, said assembly comprising:

at least one decorative knob having a male projection;

at least one snap-fastener member affixed to a fabric part and formed with a female socket on one side of the respective part and a male projection on the opposite side thereof, said female socket including a plate having a central opening for receiving the said male projection, and said male projection being integral with a plate member with said member having integral claws on its edges penetrating through said fabric part and bent over the edge of said female socket; and at least one further snap-fastener member fixed to another fabric part adapted to be connected to the first-mentioned fabric part, said further member being formed on one side of said further part with a respective female socket, said socket being releasably engageable interchangeably with any of said projections.

2. The assembly defined in claim 1 wherein each of said male projections comprises a frustoconical formation and each of said sockets is constituted with an inwardly rolled edge adapted to resiliently engage one of the frustoconical formations.

* * * * *